US005368494A

United States Patent [19]

Lai

[11] Patent Number: 5,368,494

[45] Date of Patent: Nov. 29, 1994

[54] BNC T-TYPE ADAPTER

[76] Inventor: Yang-Chuan Lai, No. 44, Lane 627, Sec. 5, Chung-Hsin Rd., San-Chung City,

[21] Appl. No.: 60,528

[22] Filed: May 13, 1993

[51] Int. Cl.[5] ..... H01R 13/703

[52] U.S. Cl. ..... 439/188; 200/51.1; 439/858

[58] Field of Search ..... 439/188, 578, 582, 620, 439/852, 858, 861; 200/51.1

[56] References Cited

U.S. PATENT DOCUMENTS 5,129,299 6/1993 Wang ..... 439/188

5,267,871 12/1993 Flanagan ..... 439/188

*Primary Examiner*—Neil Abrams

*Attorney, Agent, or Firm*—Millen, White, Zelano & Branigan

[57] ABSTRACT

A BNC T-type adapter includes a lower female conducting portion, an upper male conducting portion which is connected electrically to the female conducting portion, a grounding unit, and an insulating housing which is sleeved around the female conducting portion and which confines the grounding unit therein such that the grounding unit is disposed below the female conducting portion. The female conducting portion includes an elongated conducting plate with two outer ends, each of which is formed with a clamping unit for clamping stationarily a male conductor. The elongated conducting plate further has two opposite slanted resilient conducting strips, each one of which being formed by punching the elongated conducting plate at a location inwardly of the clamping unit so that each of the slanted resilient conducting strips has an outer joint end that is connected to the elongated conducting plate and an inner free end that extends inwardly and downwardly and that normally contacts the grounding unit.

3 Claims, 4 Drawing Sheets

BNC T-TYPE ADAPTER

BACKGROUND OF THE INVENTION

1. Field of the Invention

This invention relates to a BNC T-type adapter, more particularly to an improved BNC T-type adapter in which noise can be minimized and in which a good electrical connection can be provided.

2. Description of Related Art

FIGS. 1 and 2 show a first conventional BNC T-type adapter (1). The first conventional BNC T-type adapter (1) has a lower female conducting portion (3), an upper male conducting portion (31) which is connected electrically and perpendicularly to the female conducting portion (3), a housing (12) sleeved around the female conducting portion (3) and the male conducting portion (31), and a twist-lock member (11) mounted on one end of the housing (12) and provided adjacent to the male conducting portion (31). The male conducting portion (31) is used to mate with a female conductor (2). The female conducting portion (3) has two ends, each of which is formed with a tubular female conductor (321, 331) in order to mate with a male conductor (not shown). Each tubular female conductor (321, 331) is made from copper and has axially split parts. When the tubular female conductor (321) engages a male conductor and the tubular female conductor (331) does not engage a male conductor, the tubular female conductor (331) may pick up noise, thereby resulting in interference.

FIG. 3 shows a second conventional BNC T-type adapter (1*a*) which has a lower female conducting portion (4) and an upper male conducting portion (31*a*') that is connected electrically and perpendicularly to the female conducting portion (4). The female conducting portion (4) has two ends, each of which is bent backward so as to form a bent resilient conducting plate (42, 43) which is used to clamp a male conductor (not shown) against a housing (not shown) of the second conventional BNC T-type adapter (1*a*). A conducting chip (5) is disposed below the female conducting portion (4). A ceramic resistor (6) is disposed below the conducting chip (5) and connects the conducting chip (5) to a ground wire (not shown). It is noted that the bent resilient conducting plates (42, 43) normally contact the conducting chip (5). When the bent resilient conducting plate (42) does not engage a male conductor (not shown) while the bent resilient conducting plate (43) engages a male conductor (not shown), noise and interference can be minimized because the bent resilient conducting plate (42) is connected to the ground wire via the conducting chip (5) and the ceramic resistor (6). A main drawback of the second BNC T-type adapter is that due to the bent structure of the bent resilient conducting plates (42, 43), fatigue of the resilient force of the latter would occur after a period of use, thereby preventing firm clamping of the male conductor and thus, untimely detachment of the male conductor may occur. Therefore, the second conventional BNC T-type adapter (1*a*) cannot provide a good electrical connection.

SUMMARY OF THE INVENTION

Therefore, the objective of this invention is to provide an improved BNC T-type adapter in which noise can be minimized and which can provide a good electrical connection.

Accordingly, a BNC T-type adapter of this invention includes a lower female conducting portion which is used to engage a male conductor, an upper male conducting portion which is connected electrically and perpendicularly to the female conducting portion, a grounding unit which is provided below the female conducting portion and which is to be connected thereto, and an insulating housing which is sleeved around the female conducting portion and which confines the grounding unit therein. The female conducting portion includes an elongated conducting plate with two outer ends, each of which is formed with a clamping means for clamping stationarily the male conductor. The elongated conducting plate further has two opposite slanted resilient conducting strips, each of which is formed by punching the elongated conducting plate at a location inwardly of the clamping means so that each of the slanted resilient conducting strips has an outer joint end that is connected to the elongated conducting plate and an inner free end that extends inwardly and downwardly. The free end of each of the slanted resilient conducting strips contacts normally the grounding unit. When one of the two outer ends of the elongated conducting plate engages the male conductor, the male conductor is clamped stationarily by the clamping means and contacts a respective one of the slanted resilient conducting strips while the free end of said one of the slanted resilient conducting strips detaches from the grounding unit.

In one preferred embodiment, the clamping means on each outer end of the elongated conducting plate includes a protrusion which projects downward from the outer end of the elongated conducting plate. When one of the outer ends of the elongated conducting plate engage the male conductor, the protrusion clamps tightly the male conductor against the insulating housing so as to position the male conductor.

In another preferred embodiment, the clamping means on each outer end of the elongated conducting plate includes a tubular clamping member which is formed on the outer end of the elongated conducting plate and which extends outwardly therefrom.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENT

Figure 1:
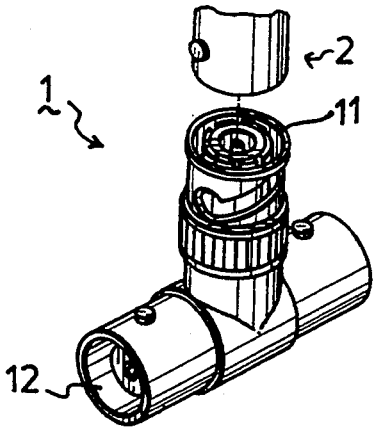
FIG.1 PRIOR ART
FIG. 1 is a perspective view of a first conventional BNC T-type adapter.
Figure 2:
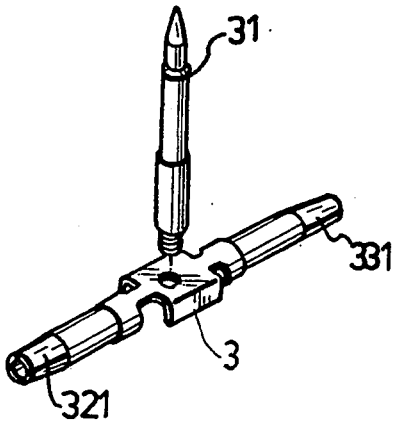
FIG.2 PRIOR ART
FIG. 2 is a partially exploded view of the first conventional BNC T-type adapter showing a male conducting portion and a female conducting portion.
Figure 3:
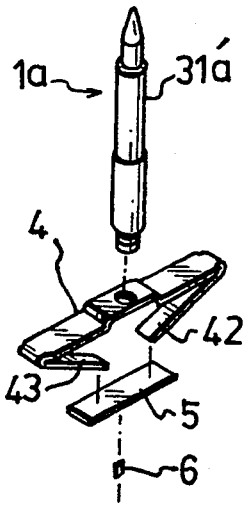
FIG.3 PRIOR ART
FIG. 3 is a partially exploded view of a second conventional BNC T-type adapter.
Figure 4:
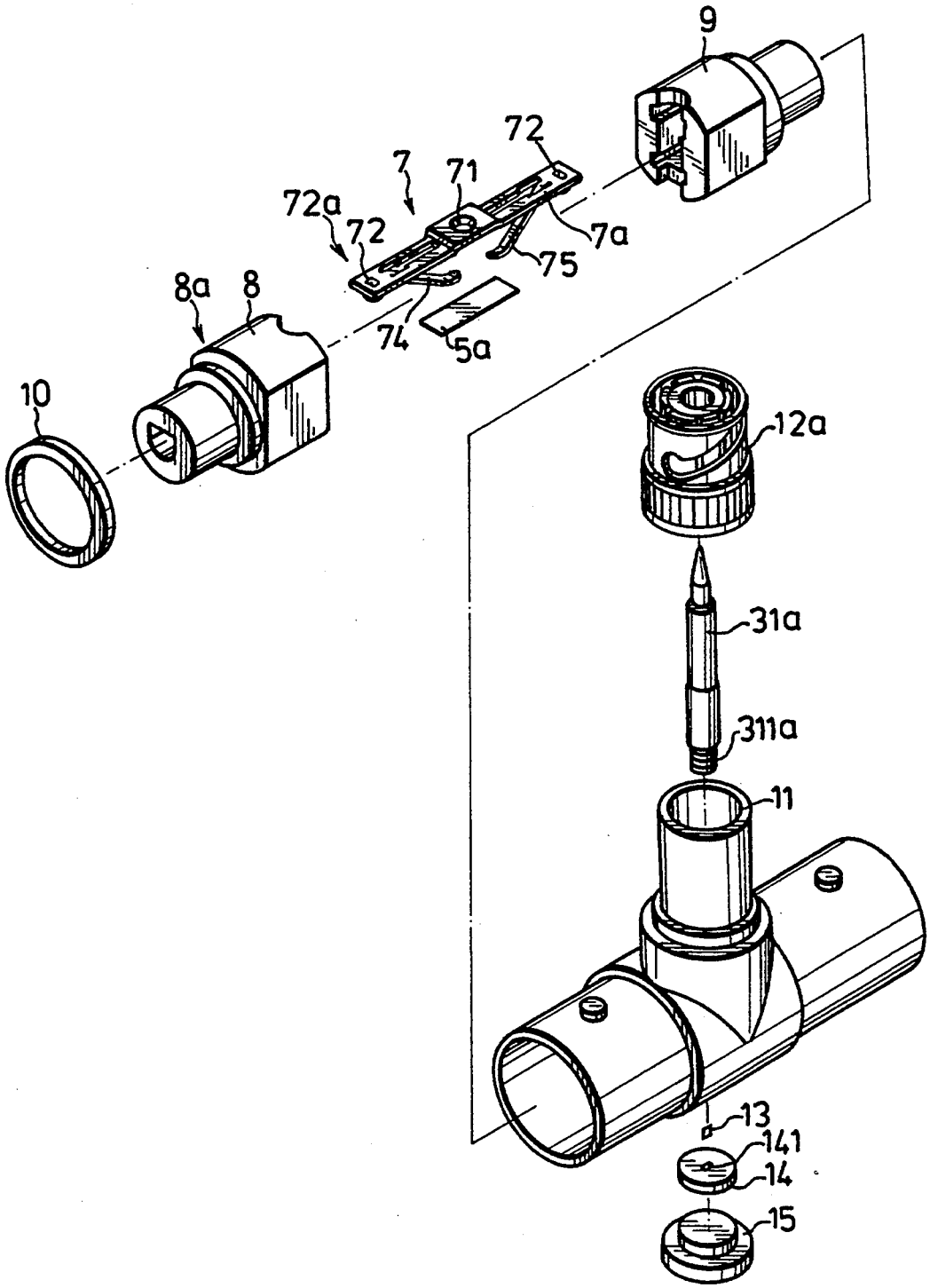
FIG. 4 is an exploded view of a first preferred embodiment of a BNC T-type adapter of this invention.
Figure 5:
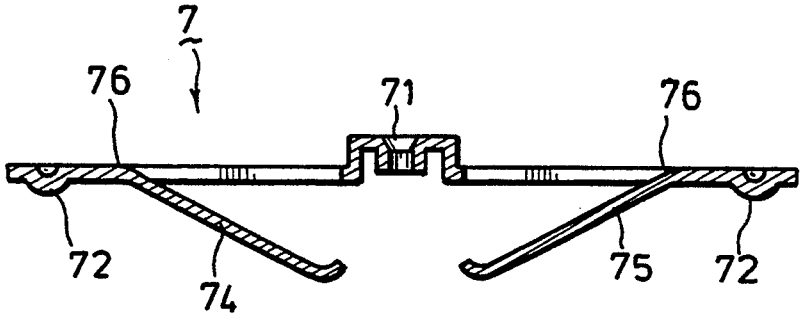
FIG. 5 is a sectional view of a female conducting portion of the first preferred embodiment.
Figure 6:
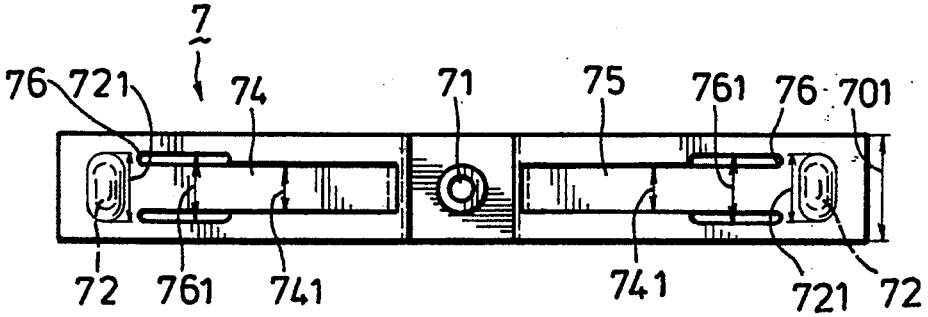
FIG. 6 is a top view of the female conducting portion of the first preferred embodiment.
Figure 7:
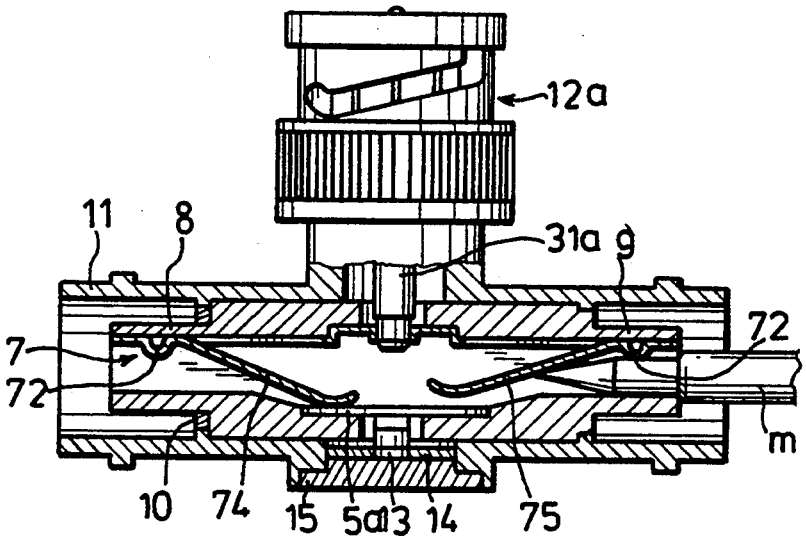
FIG. 7 is a partially sectional view of the first preferred embodiment.

It is noted that in the following detailed description of the preferred embodiments, like elements are indicated by the same reference numerals through the disclosure.

Referring to FIGS. 4 to 7, a first preferred embodiment of a BNC T-type adapter of this invention includes a lower female conducting portion (7), which has an elongated conducting plate (*7a*), and an upper upright male conducting portion (31*a*) which is formed with a lower threaded part (311*a*). The elongated conducting plate (*7a*) has two outer ends, each of which is formed with a clamping means (72*a*) for clamping stationarily a male conductor (m), and an intermediate part which is formed with a hole (71). The male conducting portion (31*a*) is connected electrically and perpendicularly to the female conducting portion (7) by means of the threaded part (311*a*) which engages the hole (71) in the elongated conducting plate (*7a*). The clamping means (72*a*) on each outer end of the elongated conducting plate (*7a*) includes a protrusion (72*a*) which projects downward from one outer end of the elongated conducting plate (*7a*) and which is formed by punching the elongated conducting plate (*7a*). It is noted that the width (721) of the protrusion (72) is smaller than the width (701) of the elongated conducting plate (*7a*). The elongated conducting plate (*7a*) further has two opposite slanted resilient conducting strips (74, 75), a respective one of which being formed by punching the elongated conducting plate (*7a*) at a location inwardly of the protrusion (72*a*) of the clamping means (72*a*) so that each of the slanted resilient conducting strips (74, 75) has an outer joint end (76) that is connected to the elongated conducting plate (*7a*) and an inner free end that extends inwardly and downwardly. Referring again to FIGS. 4 to 6, the punched portion on the elongated conducting plate (*7a*) adjacent to the joint end (76) has a width (761) which is larger than the width (741) of the slanted resilient conducting strip (74, 75) so as to minimize the possibility of contact between the peripheral edges of the slanted resilient conducting strip (74, 75) and the elongated conducting plate (*7a*).

The BNC T-type adapter has a grounding unit which includes a conducting chip (5*a*) and a ceramic resistor (13). An insulating housing (8*a*) includes two spaced parts (8, 9) and is sleeved around the female conducting portion (7). The conducting chip (5*a*) is provided in the insulating housing (8*a*) and is disposed below the female conducting portion (7). A ring-type washer (10) is provided around one end of the part (8) of the insulating housing (8*a*). A casing (11) is sleeved around the insulating housing (8*a*) and the male conducting portion (31*a*). A twist-lock member (12*a*) is mounted on one end of the casing (11) adjacent to the male conducting portion (31*a*). The grounding unit further includes an insulating seat (14), which has a hole (141) formed therein and which is disposed at a bottom of the casing (11), and a conducting cover (15), which is disposed below the insulating seat (14) and which is attached to the casing (11). The ceramic resistor (13) is positioned in the hole (141) in the insulating seat (14) and is connected to the conducting chip (5*a*) and to the conducting cover (15).

The free end of each slanted resilient conducting strip (74, 75) contacts normally the conducting chip (5). Referring again to FIG. 7, when a male conductor (m) engages one of the outer ends of the elongated conducting plate (*7a*) via the casing (11) and the insulating housing (8*a*), the male conductor (m) is clamped stationarily by the protrusion (72) against the part (9) of the insulating housing (8*a*) and contacts the slanted resilient conducting strip (75). The free end of the slanted resilient conducting strip (75) detaches from the conducting chip (5*a*) at this stage. At the same time, the other outer end of the elongated conducting plate (*7a*) does not engage a male conductor and the free end of the slanted resilient conducting strip (74) contacts the conducting chip (5*a*). It is noted that the protrusion (72) also provides electrical connection between the elongated conducting plate (*7a*) and the male conductor (m) so as to increase the electrical connecting area. Since the free end of the slanted resilient conducting strip (74) is connected to the conducting cover (15) of the grounding unit via the conducting chip (5*a*) and the ceramic resistor (13), noise and interference can be minimized. In addition, since the protrusion (72) is formed by punching the elongated conducting plate (*7a*), it can always clamp firmly the male conductor (m) against the part (9) of the insulating housing (8*a*) without the risk of fatigue of resilient force. Therefore, the BNC T-type adapter of the present invention can provide good electrical connection.

Figure 8:
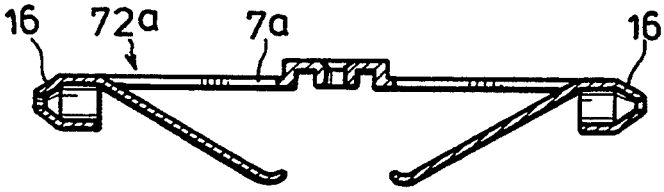
FIG. 8 is a sectional view of a female conducting portion of a second preferred embodiment of this invention.
Figure 9:
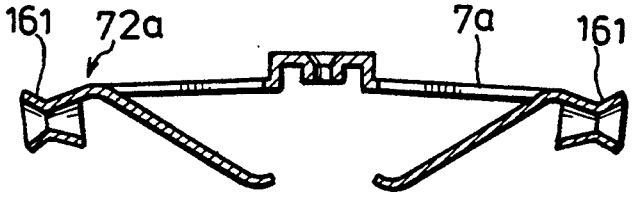
FIG. 9 is a sectional view of a female conducting portion of a third preferred embodiment of this invention.

FIG. 8 shows a sectional view of a female conducting portion of a second preferred embodiment of this invention. The clamping means (72*a*) on each of the two outer ends of the elongated conducting plate (*7a*) includes a tubular clamping member (16) which is formed on a respective one of the two outer ends. The tubular clamping member (16) has an open end portion which tapers in an outward direction toward an opening with four axially split parts in order to clamp tightly a male conductor. FIG. 9 shows a sectional view of a female conducting portion of a third preferred embodiment of this invention. A tubular clamping member (161) of the clamping means (72*a*) on each outer end of the elongated conducting plate (*7a*) has an outwardly open end portion which is formed with axially split parts and which has an intermediate constricted portion and an outwardly diverged flange in order to facilitate plug-in attachment of a male conductor.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A BNC T-type adapter comprising a lower female conducting portion which is used to engage a male conductor, an upper male conducting portion which is connected electrically and perpendicularly to said female conducting portion, a grounding unit which is provided below said female conducting portion and which is to be connected thereto, and an insulating housing which is sleeved around said female conducting portion and which confines said ground unit therein, the improvement comprising:

said female conducting portion including an elongated conducting plate with two outer ends, each of said two outer ends being formed with a clamping means for clamping stationarily said male conductor, said elongated conducting plate further having two oppositely slanted resilient conducting strips, each of which is formed by punching said elongated conducting plate at a location inwardly of said clamping means so that each of said slanted resilient conducting strips has an outer joint end that is connected to said elongated conducting plate and an inner free end that extends inwardly and downwardly, said free end of each of said slanted resilient conducting strips normally contacting said grounding unit, whereby when one of said two outer ends of said elongated conducting plate engages said male conductor, said male conductor is clamped stationarily by said clamping means and contacts a respective one of said slanted resilient conducting strips to cause said free end of said one of said slanted resilient conducting strips to detach from said grounding unit.

2. A BNC T-type adapter as claimed in claim 1, wherein said clamping means on each of said two outer ends of said elongated conducting plate includes a protrusion which projects downward from its respective one of said two outer ends of said elongated conducting plate, whereby when said one of said two outer ends of said elongated conducting plate engages said male conductor, said protrusion tightly clamping said male conductor against said insulating housing so as to position said male conductor.

3. A BNC T-type adapter as claimed in claim 1, wherein said clamping means on each of said two outer ends of said elongated conducting plate includes a tubular clamping member which is formed on a respective one of said two outer ends and which extends outwardly therefrom.

* * * * *